United States Patent [19]

Hughes et al.

[11] Patent Number: 5,020,664

[45] Date of Patent: Jun. 4, 1991

[54] ROTARY TUBE BROOM PACKAGING

[75] Inventors: John R. Hughes, Marysville; Mark S. Sutherin, Mt. Victory, both of Ohio

[73] Assignee: United Rotary Brush Corporation, Marysville, Ohio

[21] Appl. No.: 604,189

[22] Filed: Oct. 29, 1990

[51] Int. Cl.[5] ..... B65D 83/10

[52] U.S. Cl. ..... 206/361; 206/362.4; 206/389; 206/397; 206/446

[58] Field of Search ..... 206/446, 389, 395, 397, 206/415, 416, 413, 361, 362.4, 303, 209.1; 15/257 R, 179

[56] References Cited

U.S. PATENT DOCUMENTS

| | | | |
|---|---|---|---|
| Re. 25,876 | 10/1965 | Buttery et al. | 225/48 |
| 2,472,521 | 6/1949 | Danenbauer | 93/3 |
| 2,474,657 | 10/1949 | Corson | 206/59 |
| 2,713,938 | 7/1955 | Snyder | 206/52 |
| 3,291,372 | 11/1966 | Saidel | 229/51 |
| 3,333,685 | 1/1967 | Pezdek | 206/46 |
| 3,481,457 | 12/1969 | Overton, III et al. | 206/52 |
| 4,151,914 | 5/1979 | Blatt | 206/386 |
| 4,850,506 | 4/1989 | Heaps, Jr. et al. | 220/403 |

FOREIGN PATENT DOCUMENTS

| | | | |
|---|---|---|---|
| 300344 | 11/1928 | United Kingdom | 206/361 |

*Primary Examiner*—Jimmy G. Foster
*Assistant Examiner*—Thomas P. Hilliard
*Attorney, Agent, or Firm*—William V. Miller; Sidney W. Millard

[57] ABSTRACT

A polygonal protective carton for a rotary broom which has a central support tube and bristles extending radially therefrom to form a substantially cylindrical broom. The carton includes ends which have hubs that extend into the open ends of the tube to substantially suspend the broom in the carton to prevent shifting therein which would cause damage to the bristles.

9 Claims, 3 Drawing Sheets

ROTARY TUBE BROOM PACKAGING

FIELD OF THE INVENTION

This invention relates to the packaging of a rotary broom or brush of the type which comprises a central support tube or mandrel upon which a strip of flexible bristles is spirally wound. The resultant product is a substantially cylindrical body of exposed bristles with the tubular mandrel projecting from each end.

PRIOR ART

In the prior art the packaging of spirally wrapped tube broom products has historically been a problem for the industry in that the brooms are very bulky and heavy and easily damaged. They are usually packaged in square or rectangular boxes with the bristles in contact with the walls of the boxes or packing material provided therein. Due to the flexibility of the bristles the broom will tend to move in the box during shipment thereby crushing and damaging the bristles.

SUMMARY OF THE INVENTION

The present invention provides a protective package for storing or shipping a spirally wound tube broom of the type indicated. It provides a carton or container of polygonal cross-section made of fiberboard or the like which can be made from a properly scored and slit flat blank and which when set up will form a container body to receive the substantially cylindrical broom in a vertical position. Top and bottom plates are secured to the body and are so formed that they will engage the projecting ends of the tube of the broom so as to center the broom in the body and prevent axial movement therein. The result is that the broom is actually suspended within the body of the container so that it will not move axially or radially therein during shipping which might result in damage to the bristles.

BRIEF DESCRIPTION OF THE DRAWINGS

The best mode contemplated in carrying out this invention is illustrated in the accompanying drawings in which.

DETAILED DESCRIPTION OF THE INVENTION

Figure 1:
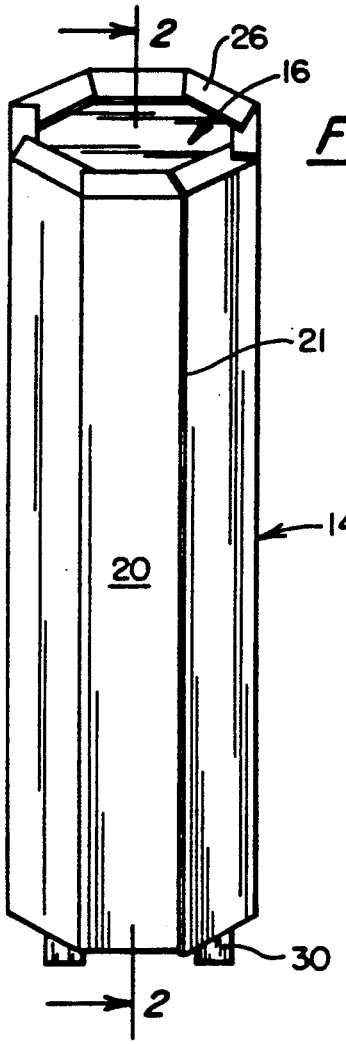
FIG. 1 is a perspective view of the packaged broom.
Figure 2:
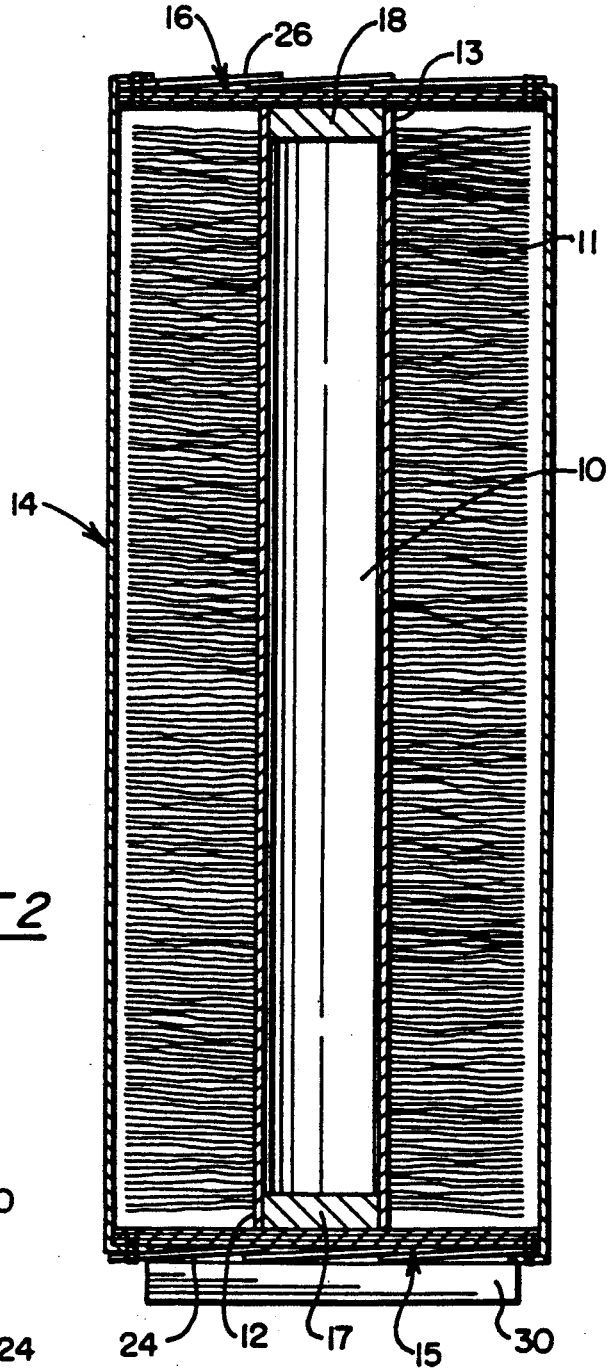
FIG. 2 is a vertical sectional view taken along line 2—2 of FIG. 1.
Figure 3:
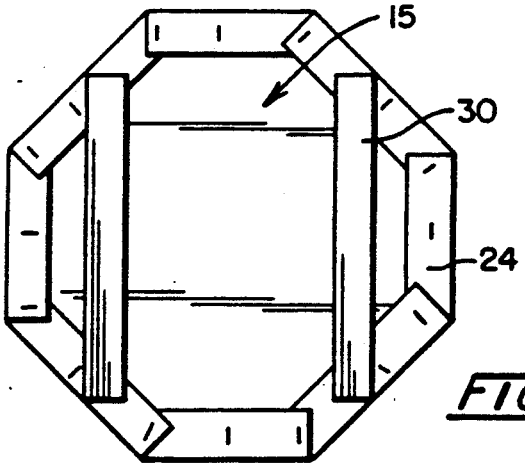
FIG. 3 is a bottom view of the package.

In the drawings, the completed package is shown in FIGS. 1 to 3. The broom is indicated as comprising a central tube or mandrel 10 having flexible bristles 11 supported thereon in the usual manner so that they project radially therefrom to form a substantially cylindrical broom. The bristles are usually carried by metal strips (not shown) which are spirally wound on the tube and fastened thereto. The tube 10 has a lower end 12 and an upper end 13 which project beyond the corresponding ends of the bristle formation.

The container for the broom is in the form of a polygonal body 14 having a bottom formed by a lower end plate 15 and a top closure formed by a top plate 16.

When these parts are assembled they will appear as indicated in FIGS. 1 and 2. It will be noted from FIG. 2 that the bottom plate 15 carries a central locating hub 17 on its inner or top surface which fits into the lower depending end 12 of the tube 10 as it rests on the top surface of the bottom plate 15. Similarly, the top plate 16 carries on its lower surface a central locating hub which fits into the upwardly projecting end 13 of the tube 10. This arrangement provides for supporting the substantially cylindrical broom in fixed axial or vertical position within the container body 14 and with the cylindrical bristle formation thereof in centered position within the container body 14 spaced from the vertical wall of the body 14 as shown in FIG. 2 or merely touching the wall. Thus, the broom is substantially suspended in the container so the bristles thereof will not be crushed in shipping, storage and handling even though the package might be disposed in horizontal position instead of its normal vertical position.

Figure 5:
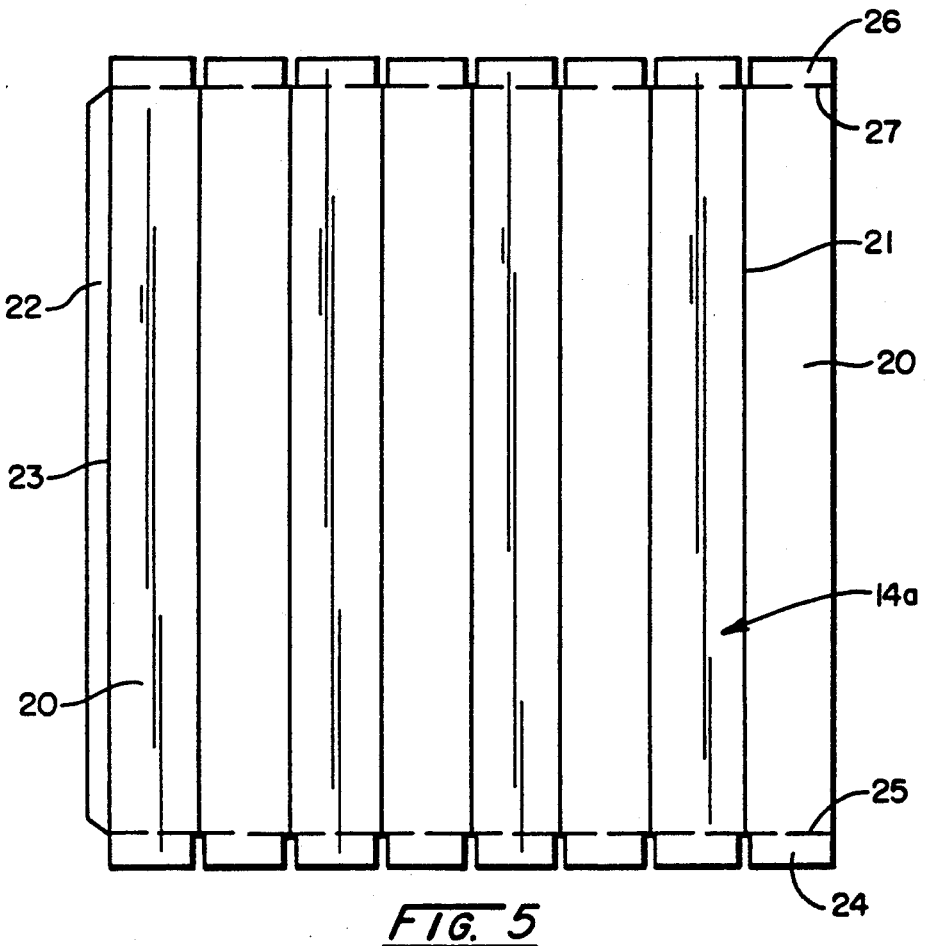
FIG. 5 is a flat view of the scored and slit blank used in making the body of the container of the package.

The container body 14 as indicated is of polygonal form. It may have a suitable number of vertical walls or panels 20 connected together along vertical hinge lines 21. In the example shown it is of octagonal form and has eight panels but this number can be varied, the larger in number, the more the container approaches cylindrical form complemental to the cylindrical form of the broom. The body 14 may be made of fiberboard such as corrugated board, chip board, paperboard or similar material. It may be made from a scored and slit blank 14*a* illustrated in FIG. 5. This blank consists of the eight panels 20 hinged together at score lines 21. In addition to the eight panels 20 a closure flange 22 is hinged at a score line 23 to the adjacent end panel 20 of the blank 14*a* and when the blank is set up it will overlap the other end panel 20 and can be glued, stapled or otherwise secured thereto as indicated in FIGS. 1 to 3 to retain it in the octagon form. Each of the panels 20 has a bottom tab 24 hinged thereto at a transverse score line 25 and a top tab 26 hinged thereto at a transverse score line 27.

The bottom plate 15 and top plate 16 are of octagonal form complemental to that of the octagon body 14 when it is set up from the blank 14*a*. These plates preferably are of plywood but may be of other suitable material. As indicated, the respective plates 15 and 16 are provided with the centering hubs 17 and 18 suitably secured to the inner surfaces thereof as by nailing, stapling or gluing. These hubs may be of wood or other suitable material. A pair of cleats 30, preferably 2×4 wood strips may be provided on the bottom surface of the bottom plate 15, being nailed, stapled or otherwise secured thereto. These are for the purpose of facilitating the pick-up of the package by a fork lift truck.

Figure 4:
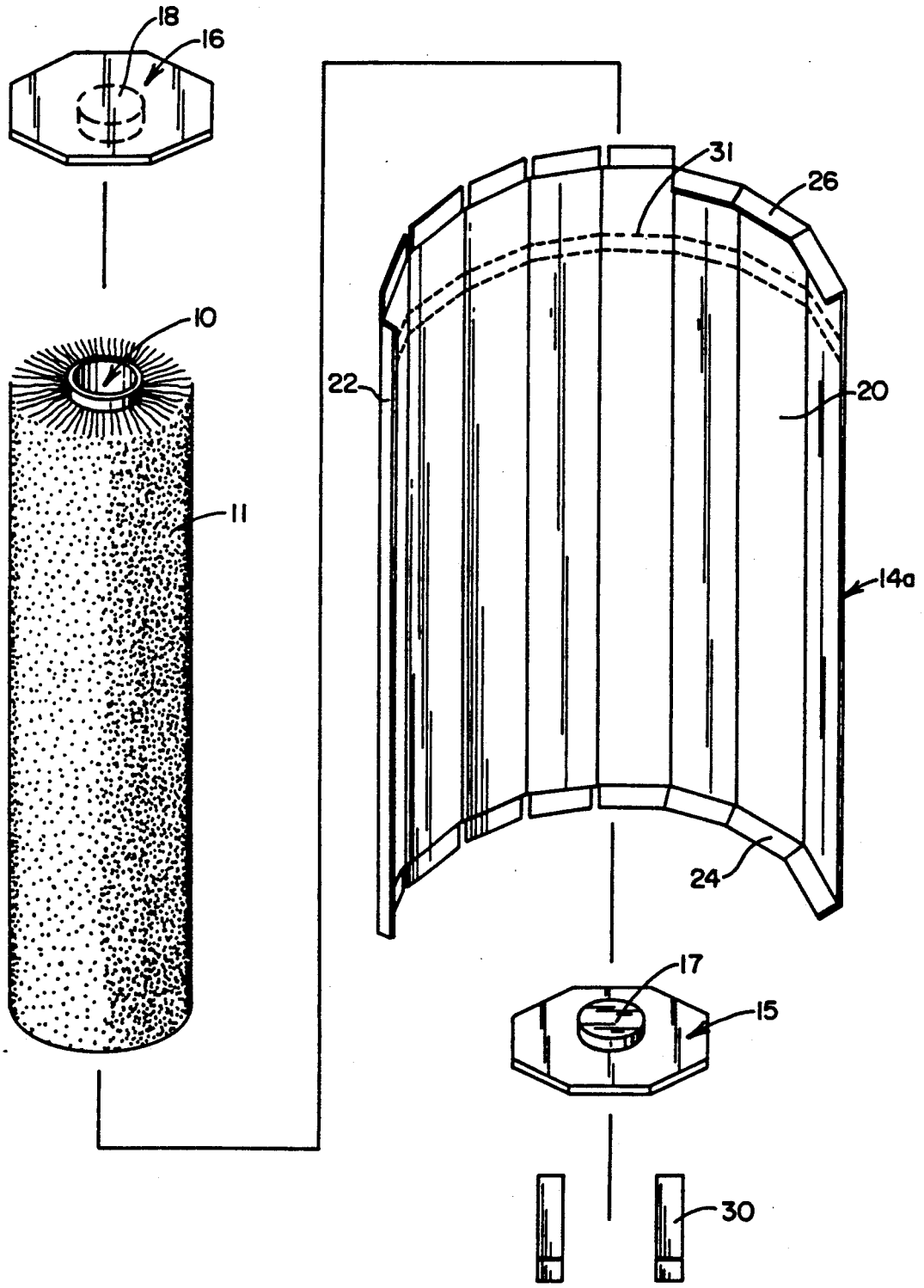
FIG. 4 is an exploded view of the package.

All the parts of the package before assembly are indicated in FIG. 4. In setting up the container or carton for receiving the broom or brush the blank 14 is folded into octagonal form with the flange 22 overlapping the opposite end panel 20 and these overlapping members are secured together. The bottom plate 15 is inserted in the lower end of the formed octagon body 14 and the lower tabs 24 are folded inwardly over the plate and stapled or otherwise secured thereto. At this time the cleats 30 will have been fastened to the bottom surface of the plate 15. This will produce the upwardly opening body 14 upstanding from the bottom plate 15 ready to receive the broom.

The broom is inserted through the open top until it rests on the bottom plate 15. The depending end 12 of the tube 10 will slip over the centering hub 17 and its end extremity will rest on the plate 15 as shown best in FIG. 3. Next the top plate 16 is inserted in the octagonal body 14 with the centering hub 18 carried thereby fitted into the upwardly projecting end 13 of the tube 10. Then the upper tabs 26 are folded inwardly over the top plate 13 and are stapled or otherwise secured thereto.

The completed package will have the broom substantially suspended in the polygonal protective carton or container. The fixed centering hubs 17 and 18 extending into the respective ends 12 and 13 of the broom tube 10 will keep the broom centered in the carton and prevent the bristles 11 from being crushed against the sides of the polygonal body 14 even if the carton is positioned horizontally at times from its normal vertical position. Axial or vertical movement will also be prevented since the ends 12 and 13 of tube 10 contact with the respective ends 15 and 16 of the carton. Thus, the broom will be protected by the enclosing fiberboard carton even during rough handling.

Figure 6:
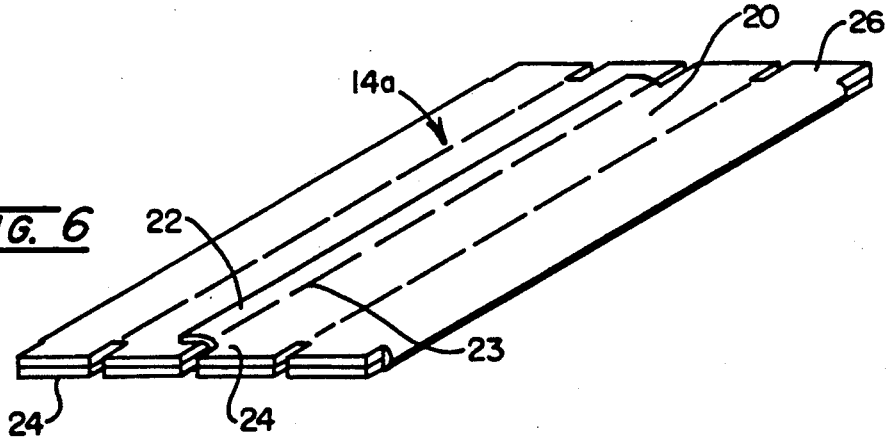
FIG. 6 is a perspective view showing how the body may be folded flat before use.

Before use, for example, for storage purpose, or shipment to another point of use, along with end plates 15 and 16 the octagon body 14 may be folded flat as indicated in FIG. 6. It can be readily set up from that knocked-down condition and the assembly of the package to the condition illustrated in FIGS. 1 to 3 can be completed.

As indicated in FIG. 4, if desired the blank **14*a* may be provided with an arrangement for producing a shorter container body. This arrangement includes a pair of parallel score lines 31 extending completely across the blank. These lines are spaced vertically the desired distance to produce the upper tabs 26** of proper vertical extent and are positioned at a selected distance from the top of the blank.

It will be apparent from the preceding description that the carton assembly will enclose the rotary tube broom in a protective manner whereby it is suspended in the carton body and is prevented from axial and radial movement which might crush or cause damage to the bristles of the broom.

Having thus described the invention what is claimed is:

1. A package for a rotary tube broom having a central tube support and flexible bristles extending radially therefrom to form a broom of substantially cylindrical form and with the tube having exposed ends, a protective carton surrounding the broom and having closures at opposite ends thereof, said closures having inwardly projecting centering means which engage with the exposed ends of said tube to center the broom in the carton and to prevent axial movement thereof.

2. A package according to claim 1 in which said exposed ends of said tube project beyond the bristles, said centering means interfitting with said tube ends.

3. A package according to claim 2 in which said exposed ends are open and said closures are in the form of flat plates, said centering means being in the form of hubs centrally located on the inner surface of said plates and fitting into the respective open ends of said tube.

4. A package according to claim 3 in which said tube has extremities which engage said plates around said hub.

5. A package according to claim 4 in which said protective carton is a body formed of fiberboard and comprises a series of panels hinged together at score lines, said closure plates being of complemental polygonal form and fitting into said body, said body having hinged tabs at score lines at each end which are bent inwardly into overlapping relationship with the respective closure plates and are secured thereto.

6. A package according to claim 5 in which the closure plates comprise a bottom plate and a top plate, said bottom plate carrying on its lower surface a pair of laterally spaced parallel fork-lift locating cleats.

7. A package according to claim 5 in which said body comprises eight panels hinged together to produce a body of octagonal form, said plates being of complemental octagonal form.

8. A package according to claim 7 in which the body includes two opposed end panels and an attaching flange hinged to one of the end panels at a score line for overlapping the other end panel and secured thereto.

9. A package according to claim 5 in which said panels have two sets of transverse score lines adjacent one end of the body, the lines of each set being spaced apart to form plate engaging tabs if desired.

* * * * *